United States Patent [19]

Crystal

[11] 4,019,437

[45] Apr. 26, 1977

[54] PLANOGRAPHIC PRINTING MASTER

[75] Inventor: Richard G. Crystal, Los Altos, Calif.

[73] Assignee: Xerox Corporation, Stamford, Conn.

[22] Filed: Apr. 13, 1973

[21] Appl. No.: 351,129

[52] U.S. Cl. ..... 101/466; 101/401.1; 101/170; 101/395; 101/150

[51] Int. Cl.[2] ..... B41C 3/06; B41C 1/10

[58] Field of Search ..... 101/455, 463, 465, 466, 101/467, 170, 401.1, 395

[56] References Cited

FOREIGN PATENTS OR APPLICATIONS

| | | | |
|---|---|---|---|
| 1,004,237 | 9/1965 | United Kingdom | 101/395 |
| 946,028 | 1/1964 | United Kingdom | 101/395 |

*Primary Examiner*—Clyde I. Coughenour
*Attorney, Agent, or Firm*—James J. Ralabate; James P. O'Sullivan; Donald M. MacKay

[57] ABSTRACT

A novel printing master and method for producing the same as disclosed, which comprises coating a suitable substrate with an uncured silicone gum, followed by the adherence thereto of a particulate image pattern. Resultant curing of the gum converts the gum to a tough elastomeric ink releasable film, thereby fixing the integral particles to the film while in intimate contact therewith. After curing, substantially all of the deposited particles are removed from the elastomer film, thereby revealing a "porous" image in the ink releasable film, of surprising ink receptive characteristics. The porous image thus is formed by contact of the integral particles of varying geometric shapes and sizes with the uncured silicone gum, thereby creating "impressions" of the particles in the gum which are then permanently stabilized in the gum by curing of the gum to an elastomeric film. The imaged printing master is then suitable for printing operations including both direct and offset lithography without a need for aqueous dampening solutions to provide ink release in non-imaged areas of the master.

10 Claims, 7 Drawing Figures

PLANOGRAPHIC PRINTING MASTER

BACKGROUND OF THE INVENTION

This invention relates to novel printing processes, particularly of the planographic type, to novel printing masters, method of forming these masters, as well as method of printing therefrom.

Conventional printing can be divided into broad process groups including relief printing, intaglio printing, and planographic printing. In relief printing, for example, the printing areas of the image carrier are raised above the plane of the substrate, which are then selectively inked for transfer to a copy sheet by direct impression. Intaglio printing involves substantially the reverse of this, in which printing areas are sunken in the image carrier, with nonprinting areas on the surface. The depressed printing areas carry applied ink which is removed in nonimage areas followed by transfer of the inked, depressed image to a copy sheet. Planographic printing is one of the better known types of printing and differs from either of the above two general types in that, printing and nonprinting areas are substantially in the same plane of the image carrier. Included within this type of printing are offset and direct lithography with the former depending on indirect image transfer from a carrier to a copy sheet, via a "blanket" or "impression" cylinder which rotates in contact with the image receiving surface and the image carrier, while the latter involves, as the term implies, direct transfer from the image carrier to the final copy or image receiving surface.

Direct lithography, while largely superseded commercially by offset lithography, has some advantages including usefulness in work where heavy ink films are essential, as well as a somewhat faster mode of operation than offset. However, because of direct contact between the image carrier and printing stock, abrasion of the image areas of lithographic plates can occur, thus life expectancy thereof is shortened, particularly if the "image" itself is relatively weak mechanically. Although it is now possible to obtain long production runs in direct lithography by means of bimetallic plates, on which the printing areas consist of one metal, and the nonprinting areas consist of a different metal, plates of this type did not exist during the time of most rapid growth of the printing industry and direct lithography, while of significant importance was therefore largely superseded by offset lithography.

In either the case of direct or offset lithography, a common denominator underlying either, is that printing and nonprinting areas are essentially in the same plane on the image carrier, and that the nonimage areas must be chemically treated to be ink repellant, and further that ink repellance in the nonimage areas must be maintained during printing by dampening the plate with a water "fountain" solution at every printing cycle. The process is thus dependent on the addition of a material such as water, which is mutually exclusive to ink, to selective areas of the imaged plate, as well as the maintenance of a balance between ink and the water during the printing process.

Planographic plate making or the formation of the imaged master, can be accomplished in a variety of ways including using a metal substrate coated with a photosensitive layer, such as a diazo compound to form a negative or positive image of a photographically applied image, as well as bimetallic plates which once imaged with a photomechanical stencil, can be selectively etched, in image or nonimage areas to provide metals of preferential sensitization for either ink or water. A more recent innovation in the formation of planographic masters, involves the use of electrophotography or xerography to image the image carrier, in which case a latent electrostatic image is formed on the surface of a photoresponsive coating which is then developed with electroscopic toner particles to form a powder image. The developed, powder image can be then transferred to a substrate and fused thereon to provide a planographic master, a solution must be applied to convert the non-imaged normally ink receptive areas of the substrate to an ink repellant or releasing condition, to thus provide a background for the relatively ink receptive, deposited toner image. After alteration of the non-image areas, the plate is then wetted with an ink which is preferentially accepted by the toner image and released by the converted hydrophilic nonimage areas.

It may, therefore, be seen that regardless of the means of imaging the planographic master, the printing system is completely dependent on the concept that a film of water which is coated over non-image areas of a printing master, will release an oleophilic or oil based ink. In this manner, the printing apparatus of the planographic variety, particularly of the offset type, necessitates the presence of various mechanical equipment for separate application of water based "fountain solution", as well as inks to the imaged master, including equipment to store these materials in adequate quantity for continuous operation, meter them as required during the process of the printing, transport them from the storage space to the printing image carrier, and distribute them properly as films to the surface of the image carrier. It may, therefore, be seen that a large amount of equipment is required to simply fulfil this function to say nothing of maintaining the delicate balance which exists between the mutually repellant ink and fountain solution thus creating numerous physical problems in metering and handling, both of which are constantly changing over the period of the printing run. Associated with this, are difficulties in maintaining proper consistency of the fountain solution, and preventing the ink from emulsifying by "backflow" of the fountain solution into the inking rollers during machine operation, as well as flowing of the fountain solution onto the offset cylinder, thus moistening the image receiving sheet causing it to curl and change dimension. Therefore, the formulation of the fountain solution referred to above, for overcoming some of these problems has become a difficult and demanding art. Planographic printing, therefore, in spite of numerous advances made therewith, is still largely dependent on operator skill in controlling the balance between ink and fountain solution, both initially and during the constantly changing conditions of the printing run. Furthermore, as opposed to complete elimination of the fountain solution, most advances in the art have been directed towards means of applying the fountain solution, or in controlling the application of it to overcome dependency on the skill of the operator to solve the attendant problems.

A different approach to overcoming the problems with fountain solutions other than the above, which is promulgated in U.S. Pat. Nos. 3,511,178; 3,677,178, 3,606,922 and 3,632,375, involves complete elimination of the need for a fountain solution or for the application of "water" to release the ink in non-image areas. This is accomplished by using a described "abhesive" background for the ink receptive image which is substantially ink releasable without regard to whether or not it is impregnated with aqueous fountain solution. The abhesive background which is releasable to the printing ink, actually keeps the ink from splitting away and transferring from the inking rollers, thus obviating a need for the fountain solution to repel the ink. This type of planographic system has therefore been characterized as a "dry" or "waterless" planographic printing system. The abhesive background in plates of this type is provided by cured silicone gums or silicone elastomers, which when dry, without being wetted by water, will not accept printing ink from an inking roller in contact therewith. On the other hand, although the need for fountain solutions has been obviated by abhesive materials of this type, nevertheless, a plate which utilizes these materials to provide ink releasable areas presents imaging problems, since the very properties of the silicone elastomer which prevents the ink from adhering to its surface also acts to prevent particulate image patterns such as toner image patterns from readily adhering to the surface thereof. Thus, the procedures normally available to sensitize lithographic masters are not suitable for planographic plates have a cured silicone elastomer coating, since various diazo sensitizers or photographic developers do not adhere well to such a surface. Therefore, the above patents overcome this problem, by constructing multilayered structures with a photosensitive layer between or overlying abhesive layers. In this manner, upon light exposure, exposed photosensitive image areas can either remain in a soluble form which is easily abraded or washed off, or be converted to an insoluble form with the non-image areas being removed. In this manner, the substrate becomes exposed in areas where removal takes place providing ink receptive areas, against the ink releasable elastomer background.

Any of the imaging systems which have heretofore been proposed with this type of planographic plate for the most part, employs photographic techniques which necessitate either additional mechanical or chemical treatment, as well as extremely long exposure times to produce an image. This not only reduces the speed involved in a complete printing operation, which includes preparation of the master, but requires the use of a planographic plate that must be carefully constructed to have a photosensitive layer, an abhesive layer and a means for securing adhesion between these two layers, in order to provide for proper imaging as well as a long life in continuous printing.

Considering the methods of imaging, available for reproduction, electrophotography and related techniques offer an advantage of simplicity, photosensitivity, and speed, which are generally unavailable to conventional photographic imaging techniques. It would therefore be highly desirable if imaging techniques of this type could be adapted to provide ink receptive image areas for abhesive, ink releasable elastomers of the type noted above. In this manner, production of printing masters could be greatly simplified, thus eliminating the need for complex photographic techniques in plate production. For example, since electrophotographic images are "developed" with toner particles, on a photoreceptive surface, this developed electrostatic image could in principle be easily adhered to an abhesive surface to provide a printing master, thus eliminating the need for any type of photosensitive layer in the abhesive coating for image formation. Such adherence, however, is difficult to accomplish since as noted above, the properties of the abhesive elastomer which prevents ink from adhering to its surface also resists adhesion of a particulate image pattern an accordingly the fixing of a toner developed electrostatic image to an elastomeric surface presents unusual problems that the ordinary image receiving surface would not.

U.S. Pat. No. 3,222,537 describes an electrophotographic element having a photoconductive layer with an overlying thermoplastic layer. A latent electrostatic image is created on the thermoplastic layer which is then developed with toner particles. Following image development, the toned record element is heated to a temperature sufficient to soften the thermoplastic layer without melting the toner particles. Under these conditions dimples are formed in the thermoplastic layer directly beneath the toner particles to form a depressed stippled image of the latent image. It is indicated that the record element may be used as a printing plate in an intaglio printing press in which the engraving ink fills the depressed image, after which the ink can be transferred to a sheet of paper. The formed element is therefore an intaglio type of master in which a depressed image is filled by ink, followed by removal of the excess ink from the surface to present ink from printing in non-image areas. The element also exclusively employs thermoplastic materials which would preferentially accept ink from a roller as contrasted to release of the ink to the roller, when a silicone elastomer is employed as the imaging surface.

The present invention is therefore directed towards a means of overcoming the inability of a surface which is substantially ink releasable, to retain a particulate image pattern in a manner which permits the use of the imaged, ink releasable member as a printing master in a continuous printing operation.

It is, therefore, an object of the instant invention to provide a novel imaged, printing master suitable for printing purposes, particularly planographic printing.

It is also an object of the instant invention to provide a method of producing such a printing master, having an ink releasable surface and useful in printing applications.

Another object is the inclusion on the printing master having an ink releasable surface, of an image which is ink receptive and capable of use in planographic type printing applications.

Still a further object of the instant invention is the provision of imaging the printing master having an ink releasable surface with a developed electrostatic image, thereby providing an imaged master which is capable of planographic reproduction.

Another object of the instant invention involves a process for printing, using a member imaged with a particulate image pattern having an ink releasable surface, and an ink receptive image which perform in a planographic type printing system without the need for an aqueous fountain solution to provide background areas of ink releasability.

Another object is therefore the provision of an offset or direct lithographic printing process which eliminates the need for an aqueous fountain solution to provide ink release in non-image areas of the master.

SUMMARY OF THE INVENTION

As previously noted, an ink releasable surface such as, for example, a silicone elastomer, will not permanently adhere an applied developed electrostatic image to yield a resultant master which is suitable for printing, since the same qualities which make the surface ink releasable in printing also resists the adherence of developed images thereto. The present invention therefore involves a method for producing a novel, printing master which comprises, coating a suitable substrate with a layer of an ink releasable material which provides an adherent surface, depositing a particulate image pattern on said layer, said particulate image pattern resulting from a latent electrostatic image, and which readily adheres to the layer, followed by curing of the ink releasable material to a nontacky ink releasable condition. After curing of the ink releasable layer, the deposited particles are removed from the cured ink release layer, thereby revealing a porous image, induced by the particles and corresponding thereto which is surprisingly ink receptive in spite of the fact that the porous image also consists of the same ink releasable material as the non-image areas. These ink receptive image areas in the ink release layer induced by the deposited image pattern, provide a printing master when inked, which is highly suitable for a continuous printing operation, without a need for treatment of the master with fountain solution or aqueous solutions of this type to prevent the ink from printing in the background areas of the final copy.

Specifically, in the present invention, the ink release material which is applied to the substrate to provide ink release areas for the printing master of the instant invention comprises a silicone gum, thereby providing a surface for adherence of a deposited particulate image pattern such as a toner image pattern but yet is capable of conversion to a tough ink releasable condition by curing or crosslinking thereof to provide an ink releasable silicone elastomer. The concept of using an uncured silicone gum to obviate difficulties in adherence of particulate or toner images or silicone elastomers is specifically described in a copending U.S. patent application, Ser. No. 351,041, filed Apr. 13, 1973 by Richard Crystal. In the noted application, a deposited particulate image pattern after fixing or fusing thereof, provides an ink receptive toner image against background areas of an ink releasable silicone elastomer for printing purposes. It has been surprisingly determined that if, after curing of the silicone gum, the fixed particulate image is removed, a porous image remains in the cured elastomer which is unexpectedly found to be ink receptive. During deposition of the particulate image pattern and fixing thereof, without substantial coalescence or fusion of the individual particles, the particles apparently penetrate into the viscous silicone gum layer, thereby causing depressions or rough areas in the gum, which are then permanently stabilized in the layer during curing of the gum to an elastomeric condition. The imaging particles apparently induce the formation of "footprints" or impressions in the ink release layer, which comprise crater-like depressions of irregular shapes, and a wide variety of sizes. Additionally, a portion of these depressions can be somewhat interconnected by the presence of holes and surface chains, to provide an essentially porous structure, thereby yielding in image configuration a porous, image of unexpected ink receptive properties.

While the present invention is not intended to be limited by any particular theory of operation, it is theorized, that most of the "texturing" of the resultant image is induced by the presence of the integral particles, thus being characterized as footprints thereof. Nevertheless, a number of smaller holes also exist in these particle footprints and surrounding them which are believed to result from both collapse of the walls of the particle or toner-induced depressions as well as from the "blowing" action of thermally decomposed materials, such as curing catalysts or similar additives present in the silicone gum. These materials are partially vaporized during curing thereby resulting in the formation of these "holes", since although the silicones are relatively permeable to gas, the particles prevent any "vaporized" material from escaping thus forming small holes in the depressions created by the particles.

The resultant porous, imaged printing master, thereby differs from prior art printing masters employing ink releasable surfaces to provide background areas, in that there is no dependence on having a multilayered and complex structure of alternating, ink release, photosensitive, and anchoring layers, as well as photographic techniques for the imaging thereof. Furthermore, an even more surprising difference is that the resultant ink receptive porous, image areas of the printing members of the instant invention have so-called adhesive properties or release values which are remarkably similar to those of the resultant ink releasable non-image areas, as measured by the adhesive release test, as defined and disclosed in U.S. Pat. No. 3,511,178. There is therefore a distinction over the prior art in this respect, since the ink receptive image areas referred to therein typically have adhesive release values more than ten times that of the ink releasable non-image areas.

In any event, a particulate image pattern can be quickly adhered to the silicone gum before curing, followed by curing and removal of the particulate image pattern to reveal a microscopic porous image of ink receptive properties thereby providing an imaged master with a high degree of utility in printing without regard to the need for aqueous fountain solutions or materials of this type to provide ink release.

DESCRIPTION OF THE PREFERRED EMBODIMENTS

Figure 1:
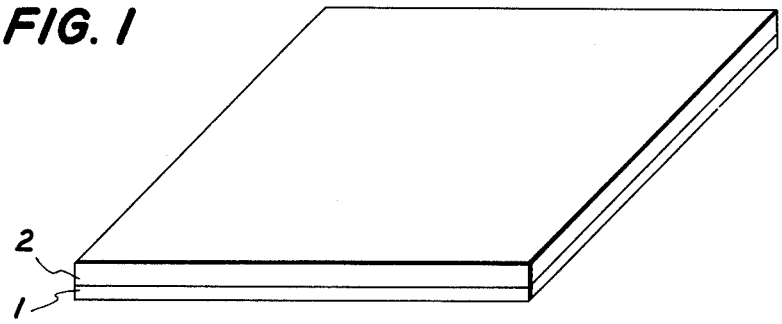
FIG. 1 depicts the formed printing master of the instant invention and its structure.

Referring specifically to FIG. 1, the printing master and method of producing the same comprises a suitable substrate 1, which can generally be any suitable type of self-supporting material including metal, plastics, paper, etc., examples of which include aluminum and other metals, polyester, polyamide, polysulfone, nylon and other relatively heat stable polymeric materials. The only functional requirements for the substrate is that, it provides for sufficient adherence of the applied ink release layer, and is compatible therewith, as well as possess sufficient heat and mechanical stability to permit use under widely varying printing and handling conditions. The present invention is therefore not intended to be limited insofar as specific materials which are suitable for the substrate provided that it meets the above-noted functional conditions.

The substrate 1, is then coated with a layer of an ink release material 2, which for the purposes of the present invention is specifically characterized as an uncured silicone gum. This material after application can be crosslinked to an essentially non-tacky and tough elastomeric surface which also provides ink releasability.

The materials, which are preferred and suitable as the precursor for the ink release surface 2 of the present invention, are the silicone gums. These materials are linear uncrosslinked polymers, which adhere readily to various surfaces and can be crosslinked to a non-tacky rubbery silicone elastomer. These elastomers have ink release properties to provide background ink releasing areas for ink receptive images without the need for aqueous solutions to provide ink release, as well as having superior mechanical properties for use in printing. For purposes of the present invention, these silicone gums are applied to the substrate and thereafter left in an uncured condition to permit adherence of a deposited particulate image pattern and thereafter crosslinked to a tough ink releasable silicone elastomer. Although the silicone gum could be characterized as an ink releasable material, nevertheless its properties which permits adherence of a toner or particulate image also makes it mechanically unsound for printing thereby necessitating that it be cured to a tougher elastomer which is also ink releasable.

The term"cured" is meant to refer specifically to the material in a crosslinked condition or the chemical connection of adjacent linear polymer chains by means of a crosslinking species. The density of crosslinking of the polymer can, of course, vary, with this intended to refer to the number of monomer units in the polymer from which crosslinks originate in relation to the total number of monomer units. Two general methods are involved in the curing or crosslinking of silicone elastomers, the first of which is the incorporation of a curing agent into the silicone gum composition and then activating the curing agent through the application of heat. Elastomers cured by this type of process are referred to as heat cured or thermosetting elastomers. Typical curing materials include either catalytic materials such as organic peroxides to stimulate the production of reactive sites on the polymer, or various reactive species which can participate in a stoichiometric reaction with the polymer unit, included among which are various types of blocked diisocyanates. The second general method of curing silicone elastomers is by carrying out the curing at ambient temperature and under atmospheric conditions thus requiring the incorporation of certain materials in the silicone gum to achieve this purpose. Elastomers of this type are generally referred to as room temperature vulcanizable or RTV elastomers. The resultant silicone elastomers cured by either process, as well as suitble mixtures thereof, have been found to provide a suitable ink releasing background for the master of the instant invention, thereby yielding a printing master of highly desirable printing characteristics.

The uncured or substantially uncrosslinked ink releasable silicone gum is preferably applied to the substrate by solvent casting techniques including dip coating and draw bar coating following dissolution in organic solvents. Solvents which may be employed include materials such as benzene, hexane, heptane, tetrahydrofuran, toluene, xylene, as well as other common aromatic and aliphatic solvents, with the particular solvent employed depending on the silicone which is to be solubilized, curing agents to be added, etc.

The thickness of the ink release layer will, of course, vary depending on the choice of materials, as well as any particular mechanical properties desired, and the present invention is not intended to be limited in this respect. Typically, however, this layer will have a thickness of between about 0.1 to 50 microns.

Following coating of the substrate, the gum will thereby provide a suitable surface for a developed electrostatic image, and thereby overcome the noted problem of getting developed images to adhere to silicone elastomers for printing purposes without sacrificing the ink release properties of the silicone elastomer.

Figure 2:
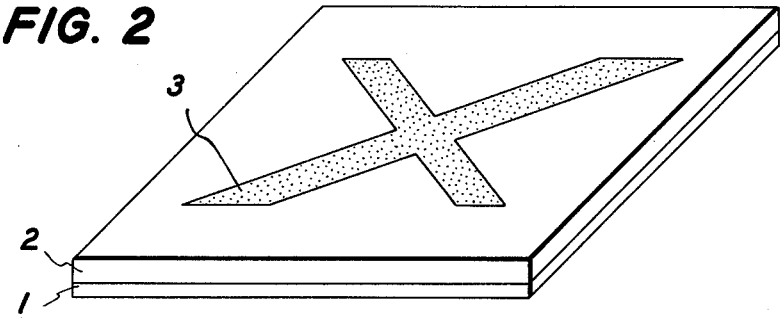
FIG. 2 depicts the printing master of the instant invention imaged with a deposited particulate image pattern.

Following application of the ink releasable material to the substrate, and with particular reference to FIG. 2, a particulate image pattern 3 is deposited on the surface of the ink releasable layer 2, said image pattern corresponding to that of a latent image, which is preferably developed on a separate photoconductive surface and transferred to the ink releasable surface. The method of forming the deposited particulate image pattern can, of course, be achieved by a variety of techniques including electrophotography which involves the electrostatic charging of a photoconductive insulating layer, followed by exposure to a pattern of activating radiation such as light, which selectively dissipates the charge in the illuminated areas of the photoconductive insulating layer while leaving a latent electrostatic image in the non-illuminating areas. The latent electrostatic image may then be developed to form a visible image by depositing finely divided electroscopic marking particles on the surface of the photoconductive insulating layer. Other means of forming the resulting particulate image pattern for imaging of the ink releasable surface include photoelectrophoretic imaging as generally described in U.S. Pat. No. 3,384,566, U.S. patent application, Ser. No. 104,398, filed Jan. 6, 1971, and U.S. patent application, Ser. No. 104,389, filed Jan. 6, 1971, which is now abandoned, as well as migration imaging techniques as set forth in U.S. patent applications, Ser. Nos. 837,591 and 837,780, both of which were filed June 30, 1969, may also be employed to yield a particulate image pattern which can be applied to the ink releasable surface and thereby provide image areas therein for printing purposes.

Insofar as development of the electrostatic image, means of development will be dictated by the particular imaging technique, but insofar as conventional xerography, cascade development as set out in U.S. Pat. Nos. 2,618,551 and 2,618,552, powder cloud development as described in U.S. Pat. Nos. 2,725,305 and 2,918,910 and magnetic brush development as in U.S. Pat. Nos 2,791,149 and 3,015,305 may, of course, be employed.

The present invention is not intended to be limited insofar as the specific type of particulate material used to develop the latent image, and any conventionally known toner can be conveniently employed, including those described in U.S. Pat. Nos. 2,788,288, 3,079,342, and U.S. Pat. Re. No. 25,136, these typically comprising various styrene polymers, copolymers, and various other types of thermoplastic materials. Other types of particulate materials, other than thermoplastic materials, are suitable without regard to their composition since the only function of the particles in the instant invention are to induce formation of a porous ink receptive image in the ink release layer, and such materials as would be suitable could be readily determined by one skilled in the art.

The silicone gum in an uncured state adheres the deposited particulate image pattern in image configuration after electrostatic transfer of the particulate image pattern to the silicone gum. If the image pattern is transferred to the relatively tacky silicone gum from an adjacent photoconductive surface, it is preferable that the photoconductive material have a surface which is non-compatible with the silicone gum and which prevents adherence of the gum thereto, otherwise the photoconductive material can be damaged besides also disrupting the characteristics of the image pattern on the silicone gum. One means of accomplishing this, although the following is not intended to be limiting, includes having the photoconductive surface coated with a releasable material provided that it does not interfere with the photoconductive properties of the surface. Typical materials for this purpose include fluorocarbons such as polytetrafluoroethylene, polydimethylsiloxane elastomers, polyethylene, polypropylene, or similar materials. If it is not possible to coat the photoconductive surface, transfer of the particulate image from the photoconductive surface may be made to a "release type" intermediate image receiving member which provides contact with both the silicone gum as well as the photoconductive surface. In this manner, a wider range of coatings can be employed to prevent adhesion of the silicone gun to the transfer surface while transferring the particulate image pattern. These include the use of lubricated surfaces carrying silicone oil or hydrocarbons as well as water swelled surfaces such as gelatin or other swelled polymers, in addition to using low adhesion polymeric materials such as those noted above. In any event, the manner of overcoming this problem is not deemed to be critical to the production of the printing master of the instant invention and the particular means involved may be readily perceived by one skilled in the art. In any event, the deposited particulate image pattern adheres to the ink release material, thus providing a means to image an ink release material without mechanical assistance or similar means.

Figure 3A:
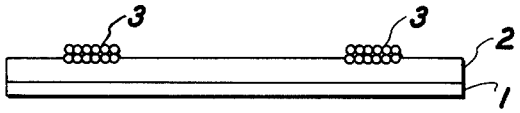
FIG. 3A shows a side view of the printing master of the instant invention after the particulate image pattern is deposited.
Figure 3B:
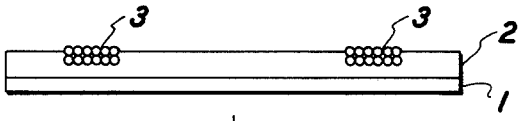
FIG. 3B shows a side view of the printing master after curing of the ink release layer.

With specific reference to FIGS. 3A and 3B and following deposition of the particulate image pattern 3 on the silicone gum 2 as is shown in FIG. 3A, the gum must be converted or cured to a tough, non-tacky silicone elastomer 2 thereby providing a tough permanent and resilient ink release surface suitable for printing as is shown in FIG. 3B. In this manner, the deposited particulate image pattern 3 comprising integral particles, become firmly affixed to the gum, penetrate it and are mixed therewith.

Conversion of the gum to a tough silicone elastomer and the manner in which it is achieved depends on the specific gum composition, and the manner and degree to which crosslinking of the gum is to be carried out, although insofar as possible, if the toner or particulate material is meltable, fusion of the particulate material prior to curing should be avoided as much as possible. The gum composition can therefore comprise thermally curable silicone elastomers, RTV silicone elastomers or mixtures thereof.

Typical silicone gums which are of the heat curing or thermally curable type suitable for use in the instant invention include Y-3557 and Y-3602 silicone gums available from Union Carbide Company, New York, N.Y., as well as No. 4413 silicone and No. 4427 heat curable silicone gums available from General Electric Company, Waterford, N. Y. Other typical materials which are suitable include Dow Corning S2288 silicone gum, available from Dow Corning Corporation, Midland, Mich. The Y-3557 and Y-3602 gums specifically have aminoalkane cross-linking sites in the polymer backbone which react with a diisocyanate crosslinking agent such as a blocked isocyanate over a wide range of temperature and time to produce a durable, ink releasable elastomeric film. The time and temperature relationship for crosslinking of all of these different types of gums is controlled by the chemistry of the crosslinking agent employed and a large choice of agents are available for this purpose. The present invention is therefore not intended to be limited with respect to either time or curing temperature of these materials, or the specific materials used to achieve crosslinking, although heating at temperatures between about 50° C and 300° C will typically cure or convert the silicone gum to an ink releasable silicone elastomer.

In the event, the RTV silicone gums are employed singularly or in a mixture with a thermally curable gum, typical RTV gums which are suitable include RTV-108, 106, 118 silicone gums available from General Electric Company, Silicone Products Division, Waterford, N.Y. These gums are capable of being cured to a crosslinked elastomeric state by standing at ambient temperatures and with exposure to the atmosphere.

Any of the above described silicone gums are not dependent on having a specific density of crosslink sites on the polymer, these being capable of variation over a wide operative range and the present invention, is not intended to be limited in this respect, with the main criteria being the formation of a non-tacky durable, and ink releasable elastomeric surface by the process of curing the gum.

Again with reference to FIGS. 3a and 3b, after the deposited particulate image 3 pattern is applied to the uncured silicone gum, the image pattern comprises particles having a variety of geometric shapes and sizes which penetrate into, are wetted by and mix with the somewhat viscous silicone gum to disrupt the liquid phase, thereby causing discontinuities in the silicone gum corresponding to the geometry and size of the particles. This creates a structure which is then chemically stabilized or made permanent in the silicone layer by cross-linking or curing of the silicone gum to an elastomer. Additional holes or discontinuities which are present, are provided by the collapse of certain of the pores, as well as by the blowing action of thermally decomposed or vaporizable materials present in the silicone gum composition thereby providing a porous image, which up to now is at least partially filled with the deposited particles.

It is to be noted that it is important to avoid conditions which substantially coalesce or fuse the particles of the image pattern before curing of the layer takes place at least if these particles comprise meltable toner, since it is the integral shape and geometry of the particles which create the ink receptive footprints in the cured silicone layer, and the formation of smooth depressions in the silicone layer before curing by the melting or coalescence of the particulate image is to be avoided as much as possible.

Instead, the conditions for curing with a meltable toner, are such to only obtain intimate contact of the integral particles 3 with the silicone gum phase 2 thereby fixing them in the phase in such a manner that they induce the formation of an ink receptive porous image in the silicone layer which is chemically stabilized after curing of the layer to an elastomeric condition.

Figure 4:
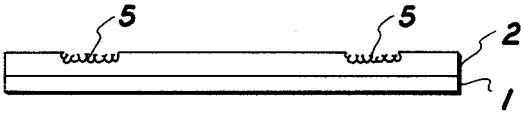
FIG. 4 shows a side view of the printing master of the instant invention after curing of the ink release layer and removal of the particulate image pattern.

In reference now to FIG. 4, after the particlate image pattern is fixed by curing of the gum to an elastomeric condition, removal of a substantial number of the particles is carried out, thereby leaving the "empty" pores 5 which are now chemically stabilized by crosslinking or curing of the silicone gum, thereby creating a porous image 5 in the layer 2 corresponding to the deposited particulate image pattern.

The particles can be removed in a variety of ways including dissolution, evaporation, abrasion, etc., and the present invention is not intended to be limited in this respect. Specifically, dissolution, including washing or scrubbing out the particles with appropriate solvents is, of course, the method of choice and within this method is included the concept of using certain inks containing appropriate solvents to dissolve the particles as well as simultaneously ink the plate. The use of inks to remove the particles during printing eliminates the need for a separate operation for removal of the toner particles. The particular solvents used for this purpose will, of course, vary depending on the specific composition of the toner particles, as well as its effect on the silicone elastomer since the solvent should not otherwise disturb or disrupt the ink release properties of the elastomer, and it is therefore apparent that the choice of solvent may be easily determined by experimentation. Typical solvents which have been found suitable for most of the conventional thermoplastic toners include acetone, methyl ethyl ketone, and other common aromatic and aliphatic solvents, all of which remove a substantial number of the integral particles thereby exposing the chemically stabilized footprints of the particles, and other disruptions caused thereby. These resultant voids create a porous image 5, which has been surprisingly determines to be ink receptive, while the silicone elastomer background remains ink releasable, thereby creating sharply defined images of good resolution and contrast when these ink receptive images on the ink releasable background are inked and used in printing.

Figure 5:
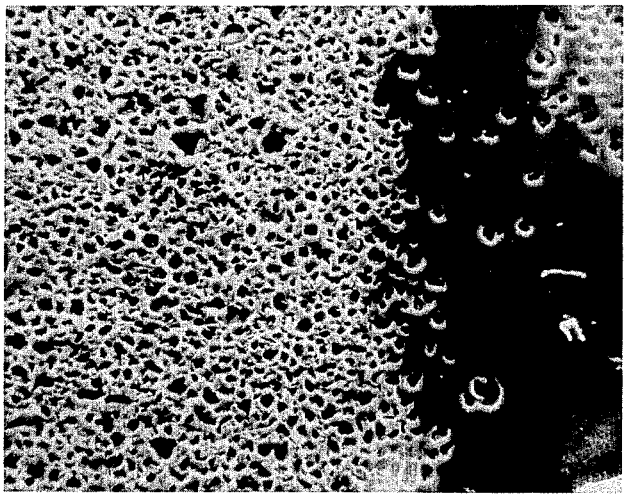
FIG. 5 is a scanning electron photomicrograph showing a top view of the porous ink receptive image areas of the instant invention after removal of the particulate image pattern, taken at 220 × magnification and contrasted against non-image areas of the master.
Figure 6:
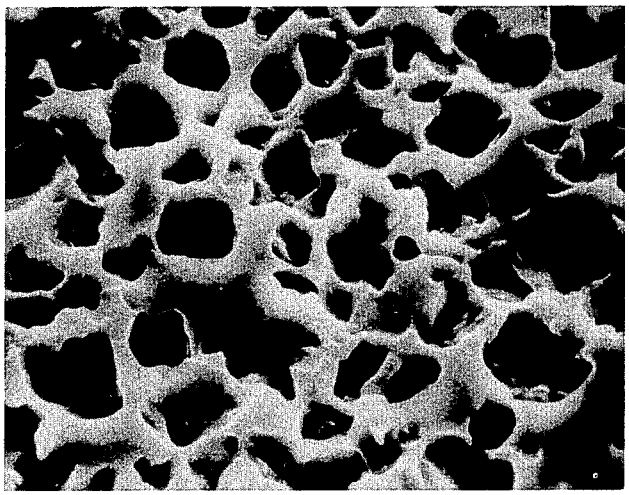
FIG. 6 is a scanning electron photomicrograph showing a top view of the porous ink receptive image areas of the instant invention after removal of the particulate image pattern, taken at 1100 ×.

FIG. 5 is a scanning electron photomicrograph taken at 220 × magnification showing a portion of the porous image area of the printing master of the instant invention after removal of the particulate image particles and contrasted against a portion of the background areas. FIG. 6 shows an "enlarged" view of a portion of the image areas after removal of the particulate image particles taken at 1100 × magnification. The crater-like depressions therein, created by the particles may be clearly seen, as well as smaller holes existing in some of these depressions which are theorized to be due to collapse of some of the walls of these depressions as well as due to a blowing action by vaporized effect of these voids is to create image comprising a porous network of voids of various sizes which have been permanently stabilized by crosslinking or curing of the gum to a mechanically strong elastomeric condition.

The porous image is surprisingly ink receptive in spite of the fact that it consists entirely of an ink releasable material. Again, while the present invention is not intended to be limited to a particular theory of operation, it is theorized that the image accepts ink by kind of a "micro pipetting" type of action, rather than by selective wetting as in conventional lithography. The porous nature of the image could thus enable it to absorb a variety of liquids in a compression/relaxation cycle without dependence on wettability characteristics of the image structure. Indeed, this view is substantiated by the ability of the image areas of the instant printing master to accept diverse types of printing ink including oil based, water based, glycol based, and rubber based ink. An image is therefore provided against an ink releaseable background which can be employed with many types of ink, which are commercially available, thus differing drastically from prior art lithographic printing processes which were based exclusively on singular use of either an aqueous or oleophilic ink, depending on the type of fluid used to provide ink release in non-image areas. Therefore, insofar as use of the master of the instant invention in printing operations, it is not intended that a limitation be implied as to the type of ink useful with the master, since as noted above, the unique characteristics of the image area makes it ink receptivity not dependent on the type of ink employed. Typical inks falling in any of the above categories which are suitable include those generally described in *Printing Ink Technology* by E. A. Apps, (1959), Chemical Publishing Company, New York, N.Y.

The "porous imaged" printing master may thereafter be employed in a planographic printing operation including direct or offset lithography with the dampening system removed following inking of the master, and employed in a continuous printing operation to provide good quality prints over a long period of operation. The printing master of the present invention therefore obviates some well-known difficulties with prior art printing masters suitable for direct lithography since the imaged masters were not generally resistant to mechanical abrasion thereby making them suitable only for offset lithography, where the image carrier was not directly contacted with the final copy surface. The masters of the instant invention are eminently suitable in direct as well as offset modes of printing, since the ink releasable layer is mechanically strong, and resilient enough to permit continuous use in a direct mode of operation without degradation thereof. Furthermore, the applied image area possess sufficient mechanical strength and flexibility to permit use in a direct mode of printing. Inking of the master during continuous operation can thereafter be carried out with any suitable type of inking device in a conventional direct or offset lithographic apparatus.

The ink release layer of the printing master of the instant invention thus provides background areas or non-image areas which are not in any way dependent on the application of an aqueous fountain solution to prevent printing in the background areas and because of this, the resultant printing master is capable of operating in a continuous printing mode in an offset or direct lithographic printing device without dependency on a dampening system for the apparatus.

Having thus generally described the instant invention, the following examples describe the instant invention in terms of more specific embodiments although the following examples are not intended to be limiting insofar as the scope of the instant invention.

EXAMPLE I

A printing master was prepared as follows: an aluminum sheet 10 inches × 15 inches was film coated using a draw bar with a 10 percent weight solution in benzene of Y-3557 silicone gum available from Union Carbide Company, New York, N.Y., containing a "blocked" aromatic diisocyanate, specifically the acetone oxime adduct of toluene-2,4-diisocyanate as a crosslinking agent in an amount of about 0.5 to 1.5 percent by weight. The coating was allowed to air dry to remove the solvent, leaving a layer with a thickness of between about 5 to 8 microns. The plate was air dried for approximately 20 minutes at room temperature to remove residual traces of solvent.

Thereafter, using a Xerox Model D Processor, a latent electrostatic test image containing line copy was cascade developed with Xerox 2400 toner after which the developed image was transferred from the photoconductive surface to a sheet of paper coated with a Teflon spray. This sheet with the developed image was then contacted with the uncured silicone surface, and the image electrostatically transferred thereto. The plate was placed in a forced air oven and heated at 175° for about 2 minutes. Following this, the entire plate was acetone washed to remove all toner particles from the imaged areas, thereby revealing a porous image, corresponding to the deposited toner pattern. Following this, the plate was attached to a Davidson dual offset lithographic press with the aqueous dampening system removed, inked with Pope and Gray No. 2441 oil based ink, and in an offset mode of operation a total of 25,000 copies were made which were good reproductions of the master and of good quality. No difference noted in copies throughout the test run and no master plate failure could be noted in any area.

EXAMPLE II–XI

A group of printing masters were prepared as generally described in Example I, and imaged in an identical manner as described, using a Xerox Model D Processor, with the exception that with each of the masters-prepared, the specified silicone gum composition was employed, as is indicated in Table 1, to achieve the indicated thickness of the ink release layer, and insofar as the test images, line as well as half toner images were used for imaging of some of the masters. Thereafter, the individual masters were placed on a Davidson Dual Press with the dampening system removed, inked with Pope and Gray No. 2441 oil based ink and used in either a direct or offset mode of operation to result in the number of indicated copies of the described quality for each master, the printing masters being generally tabulated below in Table 1, along with the results of the printing operations obtained with each.

TABLE 1

| Example | Silicone Compound | Silicone Film Thickness (microns) | Test Image | Printing Mode | Number of Copies | |
|---|---|---|---|---|---|---|
| II | Y-3557 | 4–5 | Line Copy | Offset | 3,000 | Good prints. Clean background. Operation had no adverse effect on silicone film. |
| III | Y-3557 | 4–5 | Line Copy | Offset | 5,000 | Good prints from start to finish. Clean background, good contrast. No adverse effect on silicone film. |
| IV | Y-3557 | 4–5 | Line Copy | Offset | 25,000 | Very good prints from start to finish. Clean background, good contrast. No adverse effect noted on silicone film. |
| V | Y-3557 +10 Parts Fumed Silica | 6–8 | Half-Tone | Direct | 500 | Good prints from start to finish on smooth paper. Rather "mottled" on textured paper. Clean background and good contrast. No adverse effect on silicone film. |
| VI | Y-3557 | 6–8 | Half-Tone | Offset | 500 | Good copies on both smooth and textured papers. Clean background and good contrast. No adverse effect on silicone film. |
| VII | Y-3557 | 10–12 | Line Copy | Direct | 1,000 | Excellent copies from start to finish. Clean background and good contrast. No adverse effect on silicone film. |
| VIII | Y-3557 | 4–6 | Line Copy | Direct | 1,000 | Same comments as Example VII. |
| IX | Y-3557 | 4–6 | Line Copy | Direct | 5,000 | Excellent copies from start to finish. Clean background and good contrast. No adverse effect on silicone film. |
| X | Y-3557 | 10–12 | Line Copy | Direct | 4,000 | Same comments as Example IX. |
| XI | Y-3557 | 6–8 | Line Copy | Offset and Direct | 500 each | Excellent copies using either printing mode. Clean background and good contrast. |

EXAMPLES XII–XX

A number of printing masters were prepared as generally described in Example I using a Y-3557 silicone gum available from Union Carbide Company, New York, N.Y. The coating was allowed to dry, leaving a layer of silicone gum between about 5 to 8 microns thick. The masters were imaged as described in Example I by depositing a toner pattern thereon using a Xerox Model D Processor, with curing one of the silicone to an elastomeric condition being carried out as described. The masters were then inked with different types of inks including water based inks, rubber based inks, glycol based inks, and oil based inks to evaluate the effects of various types of ink on print quality. The specific inks used to each of these general categories are listed below in Table 2.

Also, a series of five different paper surfaces were chosen for print evaluation ranging from very smooth coated paper stock to a rough type of paper, thereby permitting a rough analysis of the effect of different qualities of paper on print quality. The different types of papers are identified below in Table 3, and included in the print analysis specified in Table 4, which includes the copies made as well as the type of ink employed.

TABLE 2

TYPES OF INKS USED IN PRINTING TESTS EXAMPLES IX–XIX

| | |
|---|---|
| 1. | (Water Based) Pope & Gray "Astro Green" (G–10579) Pope and Gray Division of Martin-Marieta Corporation, Clifton, New Jersey |
| 2. | (Rubber Based) Van Son Holland "Black" (10850) Van Son Holland Ink, Corporation of America, Mineola, New York |
| 3. | (Glycol Based) BPI Hydrosheen "Black" (RO–1–71–0146) |
| 4. | (Oil Based) Pope & Gray Lithographic "Black" (2441) Pope and Gray Division of Martin-Marieta Corporation, Clifton, New Jersey |

TABLE 3

TYPES OF PAPERS USED IN PRINTING TESTS EXAMPLES IX–XIX

| | |
|---|---|
| A. | Alcor Handmade White (70 No.) |
| B. | Hammermill Long Grain, Pearl 850 (70 No.) Hammermill Paper Company, Erie, Pa. |
| C. | Hammermill, White Wover Finish (70 No.), Hammermill Paper Company, Erie, Pa. |
| D. | Xerox, CCIS (Coated One Side), (70 No.) Xerox Corporation, Stamford, Conn. |
| E. | Xerox, XL620 (Lightweight), White (12 No.) Xerox Corporation, Stamford, Conn. |

TABLE 4

GENERAL PRINT ANALYSIS ON VARIOUS PAPER STOCKS

| | | | | A | | B | | C | | D | | E | |
|---|---|---|---|---|---|---|---|---|---|---|---|---|---|
| Example | Ink | Printing Mode | Total Copies | Image | Back-ground | Image | Back-ground | Image | Back-ground | Image | Back-ground | Image | Back-ground |
| XII | Water Base | Offset | 550 | Fair | Med. | Fair | Med. | Good | Med. | Good | Med. | Good | Med. |
| XIII | Water Base | Direct | 450 | Fair to Poor | Med. | Fair to Poor | Very High | Good | Med. | — | — | Good | Med. |
| XIV | Rubber Base | Offset | 495 | Very Good | Low | Very Good | Low | Very Good | Low | Very Good | Low | Very Good | Low |
| XV | Rubber Base | Direct | 550 | Very Good | Low | Very Good | Low | Very Good | Low | Very Good | Low | Very Good | Low |
| XVI | Glycol Base | Offset | 600 | Fair | High | Fair | High | Fair | High | Fair | Med. | Fair | High |
| XVII | Oil Base | Offset | 560 | Very Good | Nil | Very Good | Nil | Very Good | Nil | Very Good | Nil | Very Good | Nil |
| XVIII | Oil Base | Direct | 540 | Very Good | Low | Good to POOR | Low | Very Good | Low | — | — | Very Good | Low |
| XIX | Oil Base | Offset | 640 | Very Good | Nil | Very Good | Nil | Very Good | Nil | — | — | Very Good | Nil |
| XX | Oil Base | Direct | 420 | Very Good | Low | Fair | Low | Very Good | Low | — | — | Very Good | Low |

Having described the present invention with reference to these specific embodiments, it is to be understood that numerous variations may be made without departing from the spirit of the present invention and it is intended to encompass such reasonable variations or equivalents within the scope, limited only by the appended claims.

What is claimed is:

1. A method of producing a printing master comprising:

a. providing a suitable substrate, b. coating said substrate with a layer of an uncured silicone gum, c. depositing a particulate image pattern on said layer, whereby said particles adhere to said layer in imagewise configuration, d. curing said layer to an ink releasable condition thereby fixing said particles in said layer without substantial coalescence of said particles, and e. removing said fixed particles to reveal an ink receptive image corresponding to said deposited image pattern.

2. A method as set forth in claim 1 wherein the uncured silicone gum is selected from the group consisting of room temperature curable silicone gums, heat curable silicone gums and mixtures thereof.

3. A method as set forth in claim 1 wherein removal of said particles is carried out by dissolution of said particles.

4. A method as set forth in claim 1 wherein curing is carried out by heating of said silicone gums.

5. A method of producing a printing master comprising:

a. providing a suitable substrate, b. coating said substrate with a layer of an uncured silicone gum, c. depositing a particulate image pattern on said layer, whereby said particles adhere to said layer in imagewise configuration, d. curing said layer to a nontacky ink releasable condition thereby fixing said particles in said layer without substantial coalescence of said particles, and e. removing said fixed particles to reveal an ink receptive porous image corresponding to said deposited image pattern.

6. A method as set forth in claim 5 wherein the uncured silicone gum is selected from the group consisting of room temperature curable silicone gums, heat curable silicone gums and mixtures thereof.

7. A method as set forth in claim 5 wherein removal of said particles is carried out by dissolution of said particles.

8. A method as set forth in claim 5 wherein curing is carried out by heating of said silicone gums.

9. A method of imaging a non-imaged printing master comprising depositing a particulate image pattern on a layer of an uncured silicone gum coated on a suitable substrate, curing said gum to an ink releasable condition thereby fixing the particles in said layer without substantial coalescence of said particles, and removing the fixed particles to reveal an ink receptive image corresponding to said deposited image pattern.

10. The method of imaging of claim 9 wherein the silicone gum is selected from the group consisting of roomtemperature curable silicone gums, heat-curable silicone gums and mixtures thereof.

* * * * *